United States Patent [19]

Tulenko

[11] Patent Number: 4,859,009

[45] Date of Patent: Aug. 22, 1989

[54] TABLE-CHEST

[76] Inventor: William Tulenko, 2734 Mount Troy Rd., Pittsburgh, Pa. 15212

[21] Appl. No.: 211,565

[22] Filed: Jun. 27, 1988

[51] Int. Cl.[4] ..... A47B 83/00

[52] U.S. Cl. ..... 312/277; 312/311; 108/64

[58] Field of Search ..... 312/241, 311, 310, 315, 312/316, 138 R, 138 A, 277; 108/64, 114

[56] References Cited

U.S. PATENT DOCUMENTS

| | | | |
|---|---|---|---|
| 555,413 | 2/1896 | Unger | 312/277 |
| 2,297,647 | 9/1942 | Chason | 108/64 |
| 2,441,728 | 5/1948 | Stanitz | 312/311 |
| 2,464,160 | 3/1949 | Stanitz | 108/114 |
| 2,493,170 | 1/1950 | Stiff et al. | 108/64 X |
| 2,686,098 | 8/1954 | Cuni | 312/311 |
| 2,690,368 | 9/1954 | Troyke | 312/311 X |
| 4,165,908 | 8/1979 | Cooper et al. | 108/64 X |
| 4,409,906 | 10/1983 | Alneng | 108/64 |

*Primary Examiner*—Joseph Falk
*Attorney, Agent, or Firm*—William J. Ruano

[57] ABSTRACT

A rectangular table-chest having pvotally opened doors at one end. The doors carrying exposed reinforcing strips for locking together with corresponding strips of a separate table. The table-chest comprises individual collapsible rectangular tables stored therein each of which includes a table top having an interconnecting strip along one side for interlocking with a corresponding strip of an adjacent support.

3 Claims, 1 Drawing Sheet

TABLE-CHEST

This invention relates to a table-chest for storing a multiplicity of tables for forming a large table or a multiple number of small tables.

BACKGROUND OF THE INVENTION

A shortcoming of tables commonly used in living rooms is that they cannot be readily stored nor interconnected in a manner to reinforce each other in the formation of a larger table.

SUMMARY OF THE INVENTION

An object of the invention is to provide a novel table-chest normally useful as a table which stores a multiplicity of smaller tables which can be used either separately or together to form a separate large table.

DESCRIPTION OF THE PREFERRED EMBODIMENT

Figure 1:
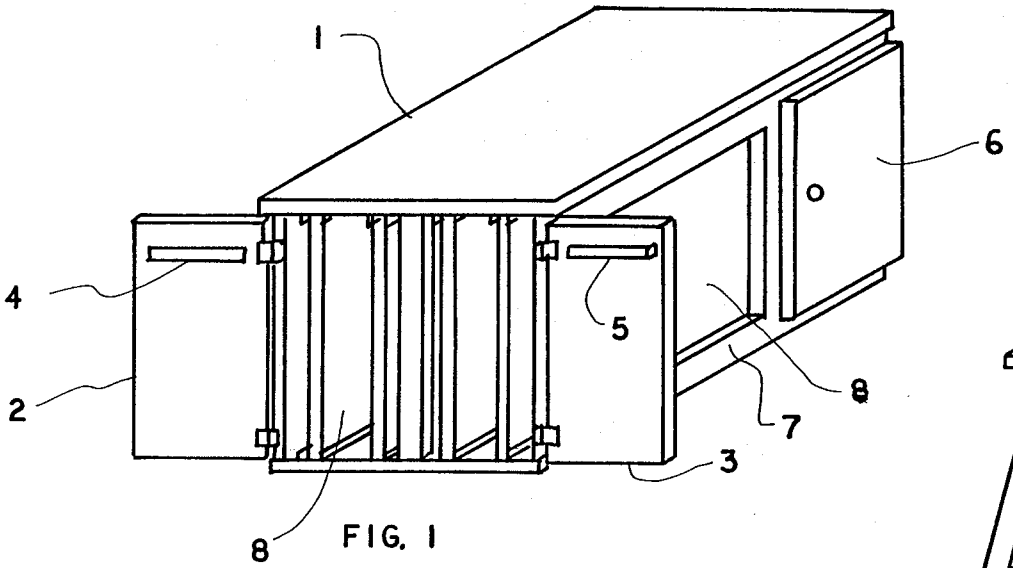
FIG. 1 is a top perspective view of a table-chest 1 which is useful as a table and which is shown with its end doors 2 and 3 in the open position.

Referring to FIG. 1, numeral 1 denotes a table-chest having pivotal doors 2 and 3 at an end and having doors 6 and a frame 7 on the sides. The interior of each frame 7 is covered by one of the table tops 8 such as shown in FIG. 2 when the legs 9 and 10 thereof are in the folded position and slid into upper and lower tracks formed in chest 1.

Figure 2:
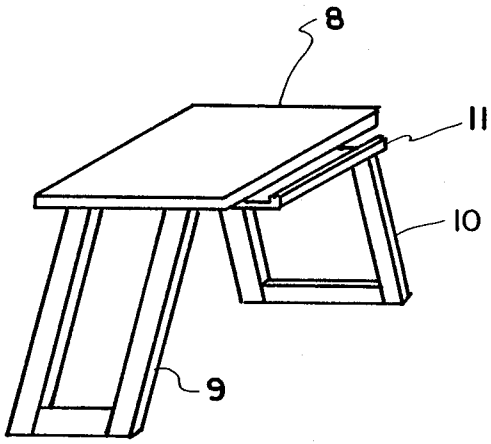
FIG. 2 shows one of the tables stored in the chest 1 of FIG. 1 when expended to the open position.

Four or more tables, such as shown in FIG. 2, are folded to the closed position by pivotally collapsing legs 9 and 10 then sliding the tables into the table-chest 1 as shown in FIG. 1.

Figure 3:
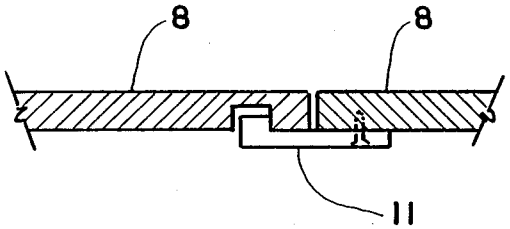
FIG. 3 is an enlarged, fragmentary view showing how table 1 and table 8 of the construction shown in FIG. 2 may be interconnected.
Figure 4:
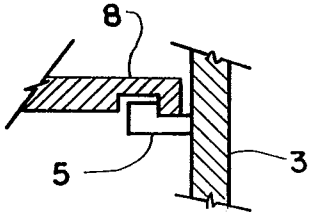
FIG. 4 is a fragmentary vertical section of door 3.

Tables such as shown in FIG. 2 can be either used seperately or, by virtue of an L-shaped extension 11, may be locked with similar tables in a manner shown in FIG. 3 to form a sturdier and larger table. Alternatively, one or more small tables, as shown in FIG. 2, may be interlocked with L shaped extensions 4 and 5, in the manner shown in FIG. 4 to form a more rigid support and to increase their top area by adding that of chest 1.

When doors 2 and 3 are pivotally closed, the table-chest 1 presents an attractive appearance as well as forming a table surface which is useful. Since the table top 8 shown in FIG. 2 also forms a filling of the rectangular opening provided by frame 7 of FIG. 1, a ligher overall construction is provided involving a minimum use of wood in the overall construction, thus providing a minimum use of wood in the overall construction and greater economy in manufacture and assembly.

Thus it will be seen that I have provided a novel table-chest for storing a plurality of smaller tables which can be used either individually or interconnected to similar tables and/or interconnected with the doors of the table-chest 1 when in the pivotally open position.

While I have illustrated and described a single embodiment of my invention, it will be understood that this is by way of illustration only and that various changes and modifications may be contemplated in my invention within the scope of the following claims:

I claim:

1. A rectangular table-chest together with individual smaller collapsible rectangular tables slidably stored therein with means for supporting tops of collapsed tables in vertical, parallel relationship, a pair of pivotally opened doors at one end of said table-chest, each of which carries, on its inner surface, an L-shaped extension in parallel relationship with and close to a top end thereof, each of said smaller tables having an L-shaped extension underneath one side thereof and a groove underneath, an opposite side thereof whereby when the L-shaped extension on one of said doors engages a groove underneath one of said smaller tables and, whereby when the legs of the smaller table are extended to the open position, an increased table top surface is provided adjacent said one of said doors.

2. A table-chest as recited in claim 1, together with a second smaller table interlocking with said smaller table by having its groove engage the L-shaped extension of the first smaller table to provide a double small table surface attached to one of said doors.

3. A table-chest as recited in claim 1 having a rectangular opening on each longitudinal side thereof which is covered by one of said small tables stored in said chest to provide lightness in weight to the entire assembly.

* * * * *